US006598787B1

(12) United States Patent
Grinsteiner

(10) Patent No.: US 6,598,787 B1
(45) Date of Patent: Jul. 29, 2003

(54) COIN RECEPTACLE ASSEMBLY WITH DOOR LOCKING MECHANISM

(75) Inventor: James J. Grinsteiner, Marinette, WI (US)

(73) Assignee: Glenview Systems, Inc., Glenview, IL (US)

( * ) Notice: Subject to any disclaimer, the term of this patent is extended or adjusted under 35 U.S.C. 154(b) by 3 days.

(21) Appl. No.: 10/052,100

(22) Filed: Jan. 17, 2002

(51) Int. Cl.[7] ..... G07B 15/00
(52) U.S. Cl. ..... 232/15; 232/43.2
(58) Field of Search ..... 232/15, 16, 43.2, 232/30, 31, 32

(56) References Cited

U.S. PATENT DOCUMENTS

| | | | | |
|---|---|---|---|---|
| 1,632,536 A | | 6/1927 | Breen | |
| 1,983,089 A | * | 12/1934 | Knee | 232/15 |
| 3,033,442 A | * | 5/1962 | Erlichman | 232/15 |
| 3,547,344 A | | 12/1970 | Christensen | |
| 3,653,586 A | | 4/1972 | Bonneson | |
| 3,677,461 A | | 7/1972 | Nitschneider et al. | |
| 3,807,627 A | | 4/1974 | Nitschneider | |
| 3,837,566 A | * | 9/1974 | McGough | 232/15 |
| 4,177,920 A | | 12/1979 | Sciortino | |
| 4,194,683 A | | 3/1980 | Finke et al. | |
| 4,267,962 A | * | 5/1981 | Domkowski | 232/15 |
| 4,289,269 A | | 9/1981 | Sciortino | |
| 4,291,831 A | | 9/1981 | Domkowski | |
| 4,359,184 A | | 11/1982 | Sciortino | |
| 4,372,479 A | | 2/1983 | Sciortino | |
| 4,456,165 A | | 6/1984 | Sciortino | |
| 5,458,285 A | * | 10/1995 | Remien | 232/15 |
| 5,611,483 A | | 3/1997 | Sciortino | |

FOREIGN PATENT DOCUMENTS

| | | |
|---|---|---|
| EP | 484851 | 5/1992 |

* cited by examiner

*Primary Examiner*—William L. Miller
(74) *Attorney, Agent, or Firm*—Silverman, Cass & Singer, Ltd.

(57) ABSTRACT

A coin receptacle assembly for vending machines. A funnel unit is positioned in the machine and a coin receptacle unit is adapted to be removably mounted on the funnel unit. The coin receptacle unit includes a secure door which is movable between an open position when the coin receptacle unit is mounted on the funnel unit, and a closed position when the units are separated. A lock arm engages against the secure door when the units are separated to prevent the secure door from being opened by an unauthorized person.

12 Claims, 10 Drawing Sheets

246
300
247
248
250
262
245
249
261
212
200
291
253
244
214
270
234
259
253
254
216
243
241

COIN RECEPTACLE ASSEMBLY WITH DOOR LOCKING MECHANISM

BACKGROUND OF THE INVENTION

1. Field of the Invention

This invention relates generally to receptacles for assembly in coin operated machines, and more particularly, to such receptacles which include a pair of cooperating units, one unit of which is adapted to be fixedly mounted on the interior of a machine for receiving coins and permitting the coins to pass therethrough and the other unit of which is adapted to be removably assembled to said one unit in position to receive and collect the coins which pass through said one unit.

2. Description of the Prior Art

Coin operated machines, such as machines for vending products, commonly include a receptacle installed in the interior thereof in position to receive and collect coins which have been inserted to activate the machine. Periodically, the machine is serviced by a person who opens the machine, removes the coin loaded receptacle, and replaces it within a special prefabricated position in the machine. The collected coins in the coin loaded receptacle are then deposited by the service person at an authorized accounting station.

Heretofore, such coin collecting receptacles have been fabricated of a pair of interacting parts, which include spring biased slides and spring catch mechanism. An example of such structure is disclosed in U.S. Pat. No. 5,611,483 (hereinafter referred to as the '483 Patent), issued Mar. 18, 1997 entitled "Coin and Currency Receptacle Assembly For Money Operated Machines." Said '483 Patent is owned by the same assignee as the assignee of the present application. The disclosure of the '483 Patent hereby is incorporated herein by specific reference.

The coin receptacle assembly of the '483 Patent does not include security triggering means for automatically locking the coin loaded receptacle when the service person removes the receptacle from its position within the machine. As an improvement to the assembly of the '483 Patent, it is desirable to provide such security triggering means to automatically lock the coin receptacle when it is removed from within the machine in which it initially is positioned to receive and collect coins.

SUMMARY OF THE INVENTION

The invention is characterized by a pair of units which can be assembled substantially universally in coin vending machines. A first unit is adapted to be fixedly installed in a dedicated location in the machine for passing coins therethrough which are inserted into the machine for activation thereof. A second unit is constructed to be removably assembled to said first unit for receiving and collecting the coins passing through the first unit. The second unit has a bag secured thereon into which the coins are collected and stored.

The second unit has a spring-biased closure member normally biased to a closed position over the upper end of a passageway therethrough for coins inserted into the machine. The first unit has integral cam means which engage said closure member when the two units are assembled together by sliding the second unit into said first unit. The two units have a cooperating spring biased latch and socket locking means for retaining the units in their locked assembly. When the second unit is assembled to the first unit, the spring-biased closure member is moved to an open position over the upper end of the passageway therethrough by engagement of the cam means of the first unit thereagainst, thereby to permit coins to pass through the first and second units into the coin collecting and storage bag.

The spring-biased closure member includes a secure door adapted to be engaged by a lock arm when the secure door is in its closed position, which occurs when the second unit is removed from said first unit. The lock arm maintains the secure door in said closed position and keeps the secure door from being opened until the lock arm is released from its engagement with the secure door. The lock arm is releasable from its engagement with the secure door only by an authorized person who has access thereto from the interior of the coin bag secured to the second unit.

Various objects and advantages of the invention will become apparent in accordance with the above and ensuing disclosure in which a preferred embodiment is described in detail in the specification and illustrated in the accompanying drawings. It is contemplated that minor variations may occur to persons skilled in the art without departing from the scope or sacrificing any of the advantages of the invention.

DESCRIPTION OF THE PREFERRED EMBODIMENTS

Figure 1:
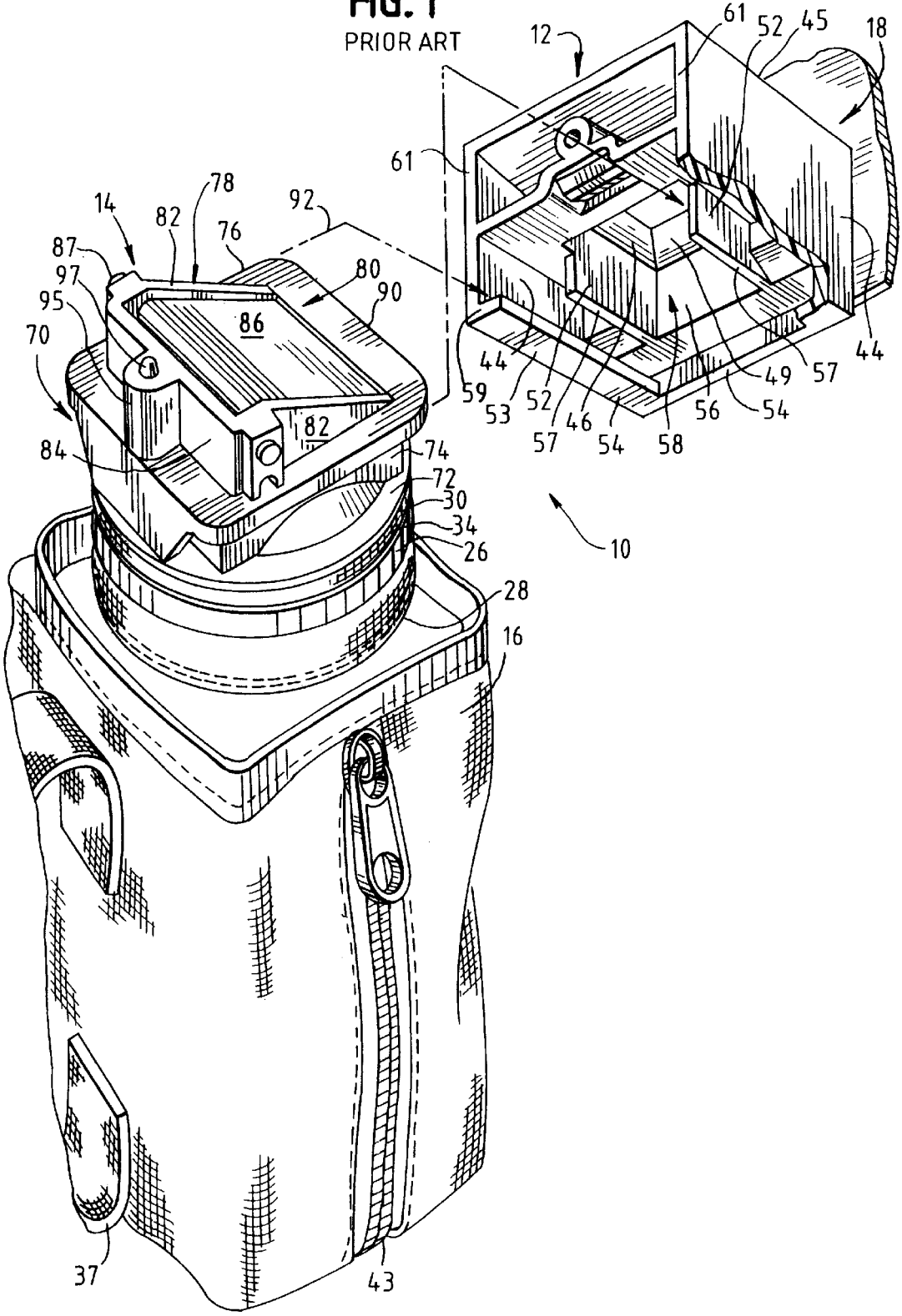
FIG. 1 PRIOR ART
FIG. 1 is an exploded perspective view of the prior art '483 Patent receptacle assembly showing the two units thereof separated but in juxtaposition for being assembled one to the other.
Figure 2:
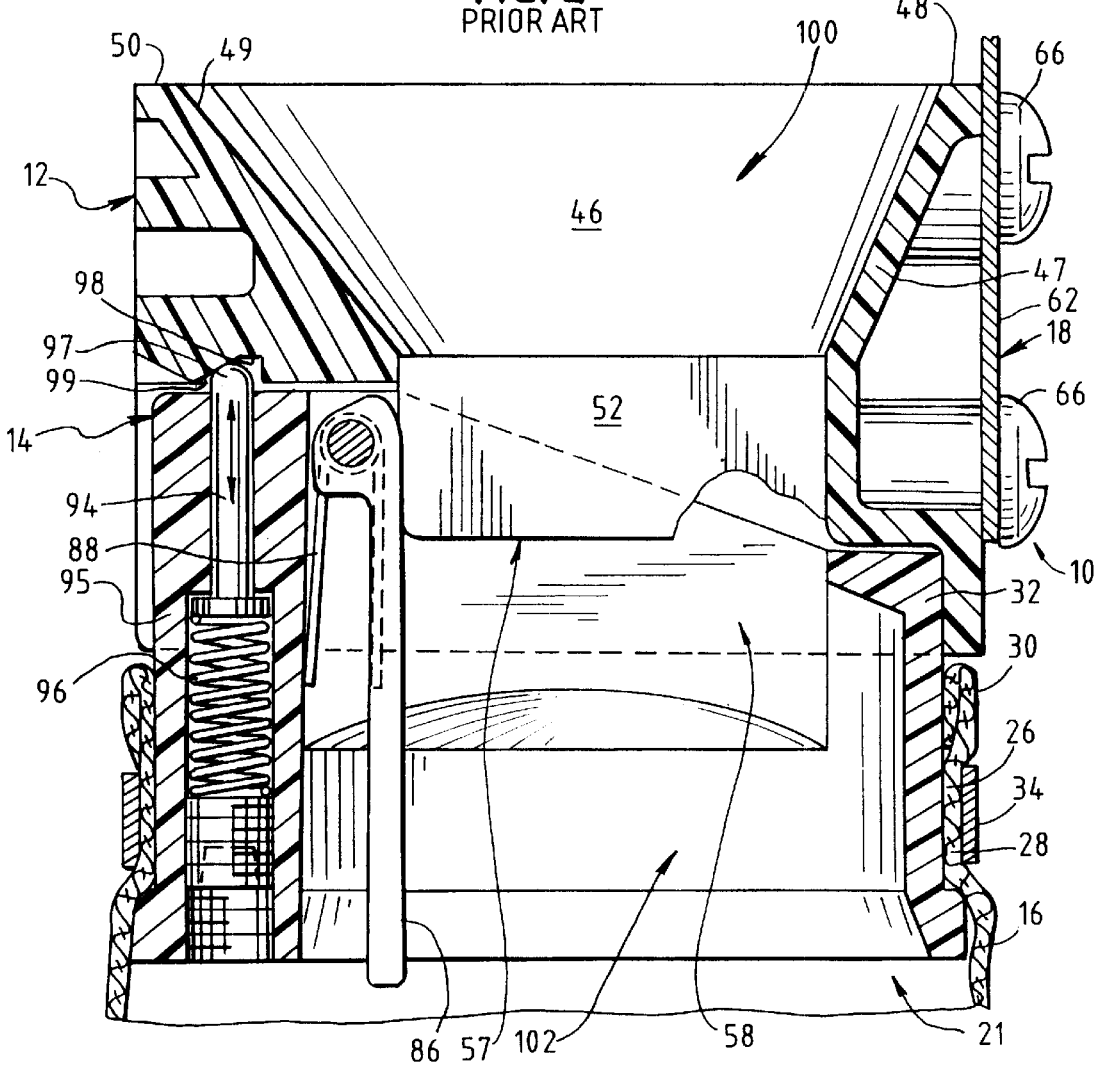
FIG. 2 PRIOR ART
FIG. 2 is a fragmentary, vertical sectional view taken through the two units of FIG. 1 assembled together.

As previously stated, the present invention is an improvement of the assembly disclosed in the prior art '483 Patent which is shown in FIGS. 1 and 2. The assembly is designated generally by the reference character 10. The assembly 10 is comprised of a funnel unit 12 and a coin and currency receptacle unit 14 to which is attached a flexible bag 16 into which coins inserted into the vending machine (not shown) are deposited and collected when they pass through the funnel unit 12. The two units 12 and 14 preferably are formed of molded plastic material and are designed to be slidably engaged and disengaged without requiring the use of special tools.

The funnel unit 12 is provided with bracket means designated generally by the reference character 18 which enable the funnel unit to be fixedly installed or anchored at different mounting locations within a coin machine's housing (not illustrated). Such a mounting location may vary between different machines so that the bracket means 18 employed can be modified to accommodate different coin machine mounting locations regardless of where the coin chute delivery is located so long as said funnel unit is properly positioned to receive the coins.

The bag 16 may provide one or more interior storage compartments. The bag includes an open-ended upstanding cylindrical wall 26 of which the lower end 28 communicates with the compartment 21. The upper end 30 of the wall 26 is secured over a cylindrical delivery throat 32 depending from the receptacle unit 14. A clamp 34 encircles the cylindrical wall 26 to clamp the bag 16 around the throat 32.

Access to the compartment 21 (in which coins are collected) is available through the zipper closure 43. A handle 37 may be attached to a side wall of the bag 16 for convenient handling of the bag.

The funnel unit 12 is a unitary structure preferably formed of a high strength synthetic polymer such as polycarbonate. The material from which the funnel unit 12 is formed may vary so long as it is of high strength, such as a suitable composite. The unit 12 is of rectilinear, box-like configuration comprised of a pair of opposite side walls 44 of equal length and width. The outer surface of each wall 44 is continuous and uninterrupted as seen in the drawings. Commencing from the upper edge 45 of each wall 44, the inner wall surface of the wall 44 is tapered inwardly along a portion of its width and along its entire length to provide an inwardly inclined ramp 46. A similarly dimensioned ramp 47 is formed extending inwardly from the upper edge 48 at right angles to the upper edges 45. Additionally, a similarly dimensioned ramp 49 is formed extending inwardly from the upper edge 50 also at right angles to the walls 44. The ramps 46, 47 and 49 form a four-wall funnel formation which is open at the upper edges 45, 48 and 50.

Each of the ramp walls 46 has an integral wall extension 52 extending downwardly therefrom parallel to the side walls 44 and terminating at a location spaced above the bottom edges 54 of the side walls 44. The ramp wall 49 also has a similarly dimensioned wall extension 56 integral with the wall extensions 52 to form a downwardly opening three-walled extension of the ramp walls 46, 47 and 49, with the exception that the ramp wall 47 is not provided with such a wall extension. This leaves an open space opposite the extension 56. The bottom edges of the wall extensions 52 and 56 define the discharge opening 58 of the funnel unit 12.

The wall extensions 52 and 56 have their bottom edges 57 spaced above the bottom edges 54 of the unit 12. Extending inwardly from each side wall 44, is a flange 53, the flanges facing one another to provide a ledge 59 on their top surfaces extending inwardly between the walls 44 the entire length of each such wall 44. The ledge 59 thus formed is spaced from the bottom edges 57 of the wall extensions 52 to provide a track extending between the ledge 59 and bottom edges 57. Said extensions 52 function as cams to open the normally closed closure means 80 of the unit 14 when the two units are engaged in the said track to form the assembly 10. The ledge 59 terminates flush with the lateral edges 61 defining the open side of the funnel unit 12, opposite the side 62 of said unit 12.

The side 62 of the funnel unit 12 has sockets formed in the corners thereof for engaging fasteners 66 therein for securing the bracket member 18 to said side 62 to enable the funnel unit 12 to be installed or anchored in the vending machine's housing in a fixed position for receiving coins inserted to activate the vending machine.

The coin and currency receptacle unit 14 is comprised of a unitary molded fixture member 70 to which the bag 16 is attached to depend therefrom. The fixture member 70 includes an annular wall 72 from which depends the cylindrical throat 32 on which the bag 16 is secured by means of the clamp 34. Upstanding on the wall 72 is the rectilinear shaped wall 74 on which is supported the platform 76 of rectangular configuration. Supported on the platform 76 is a housing 78 in which is pivotally mounted the closure member 80.

The housing 78 includes a channel-shaped vertical wall in which the parallel side walls 82 are connected by the wall 84. The side walls 82 are triangular in side elevation (see FIG. 1) and tapering away from the connecting wall 84. The closure member 80 is comprised of a door 86 which is pivotally mounted on the pivot pin 87 between the side walls 82 adjacent the connecting wall 84. The door 86 is maintained normally in a position closing the space between the side walls 82 by means of the spring 88 mounted on the pivot pin 87. The normally closed position of the door 86 is illustrated in FIG. 1 and in open position in FIG. 2 where the door is urged against the wall extensions 52. The spring 88 is a conventional coiled member from which extend a pair of arms to bias the door 86 to a normally closed position.

The member 70 has a central bore'therethrough which connects with the chamber 21 of the bag. The receptacle unit 14 is assembled to the funnel unit 12 by inserting the forward end 90 of the platform 76 into the upper surfaces of the ledge 59 as represented by the arrow 92 in FIG. 1. The unit 14 is then slid to the right whereby the cam member 52 will engage the upper surface of the door 86 to depress the door 86 downwardly to be moved toward its open position. In this engagement, the door 86 will pivot on the pin 87 against the normal bias thereagainst of the spring 88. The continued sliding movement of the unit 14 on the ledge 59 relative to the funnel unit 12 will further pivot the door 86 to a full open position depicted in FIG. 2.

The door 86 of the prior art '483 Patent is maintained in its open position when the funnel unit 12 is locked on the receptacle unit 14 by the spring biased locking pin 94. The pin 94 is retained in the abutment formation 95 integrally formed externally on the wall 84 and platform 76. The spring 96 on the interior of the formation 95 normally urges the end 97 of pin 94 to protrude outwardly of the formation 95. When the funnel unit 12 and receptacle unit 14 are fully engaged, the pin end 97 is locked in a cavity formation 98 formed in the wall 99 at the entry end into the funnel member 12.

When the assembly 10 is fully engaged, the door 86 is fully open so that coins dropping into the funnel formation 100 will pass through the passageway 102 into the compartment 21 of the bag 16. When the receptacle unit 14 is withdrawn from the funnel unit 12 in a sliding movement to the left as seen in FIGS. 1 and 2, the door 86 will be urged by the spring 88 to its normally closed position. A new receptacle unit can then be assembled to the funnel unit 12 anchored in the vending machine in the manner described above.

Figure 3:
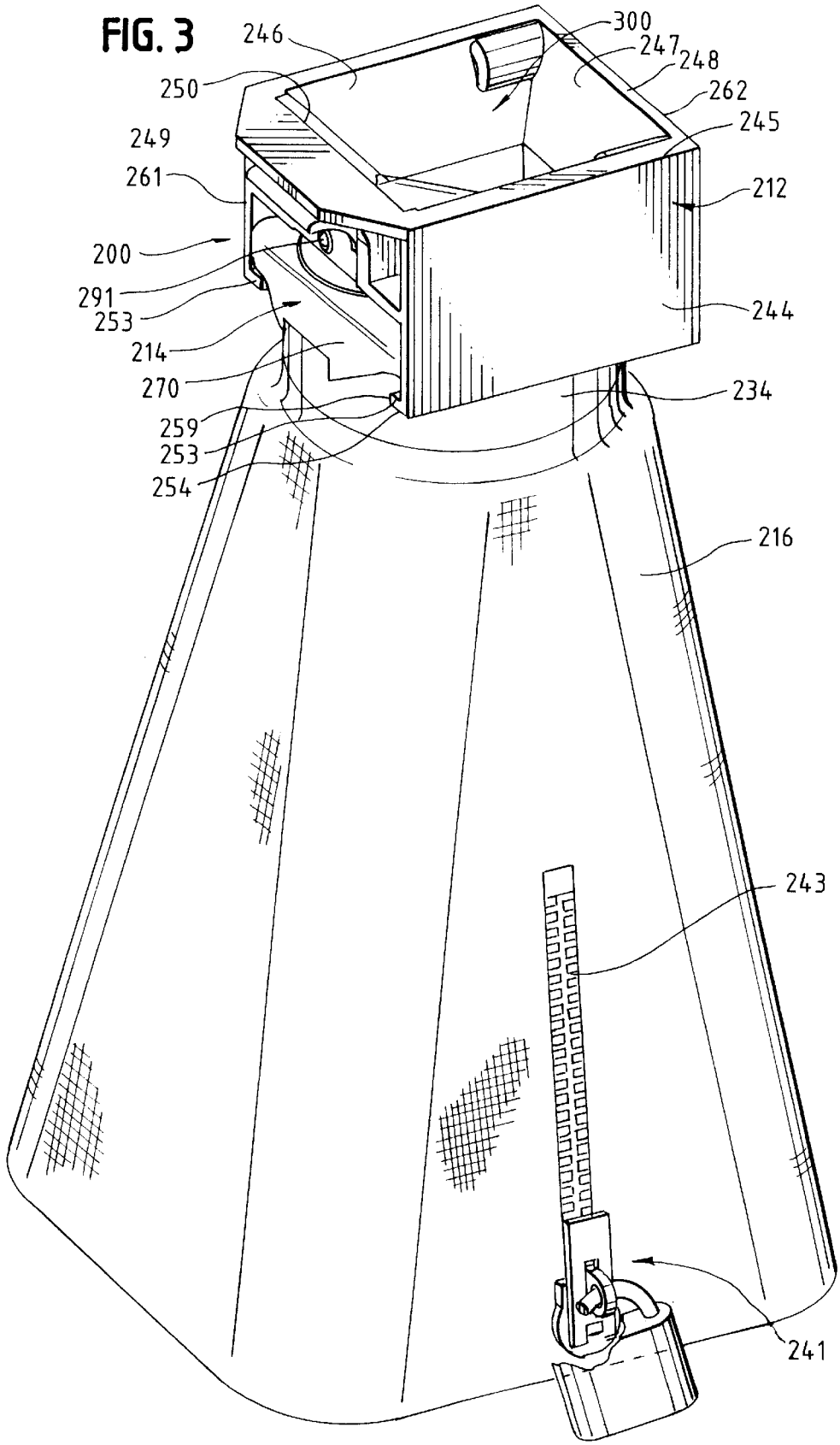
FIG. 3 is a perspective view of the receptacle assembly of the invention showing the two units of the assembly assembled together.
Figure 4:
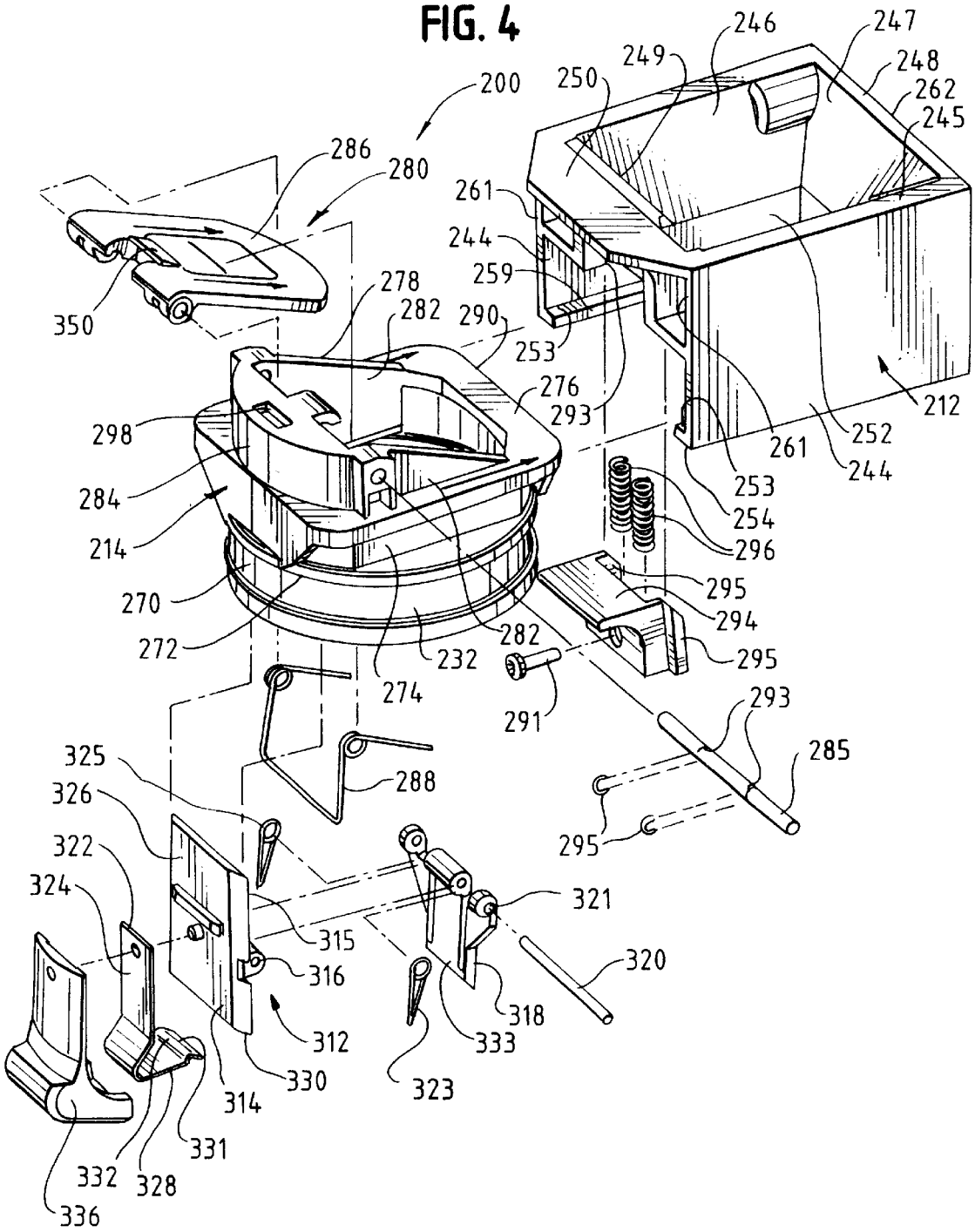
FIG. 4 is an exploded perspective view of the two units shown in FIG. 3, but excluding the coin receiving bag thereof.
Figure 9:
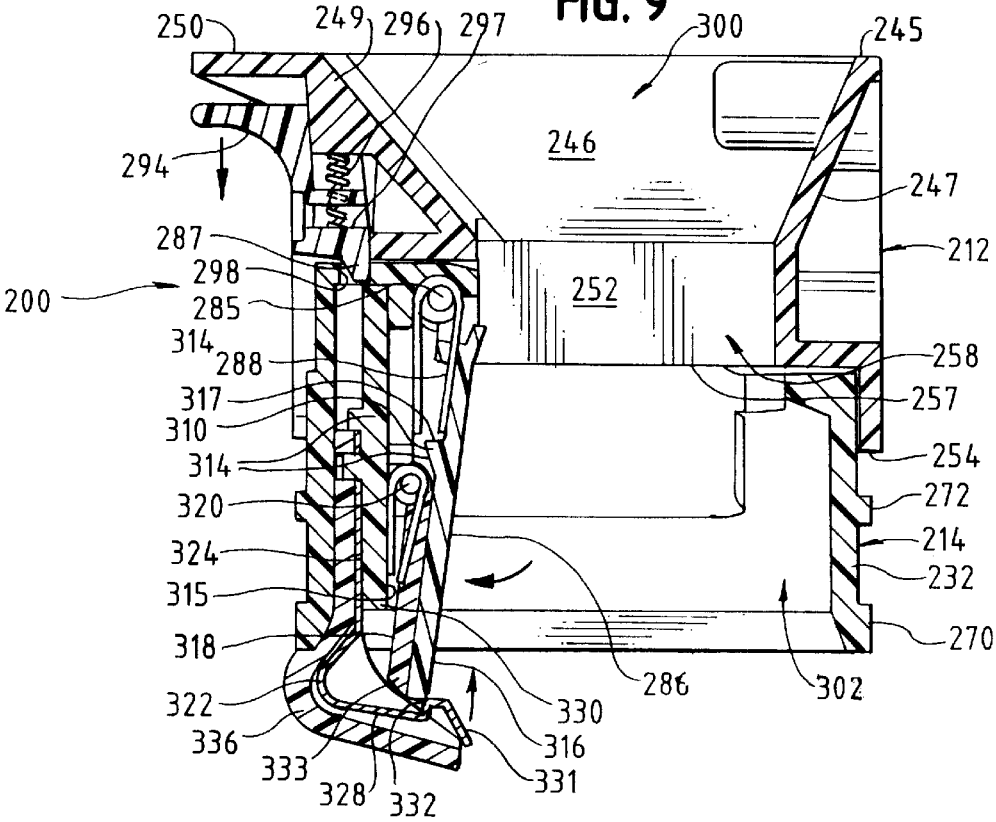
FIG. 9 is a vertical sectional view taken through the two assembled units of the invention shown with the secure door moved to its position to retain the lock arm spring in its open condition.
Figure 10:
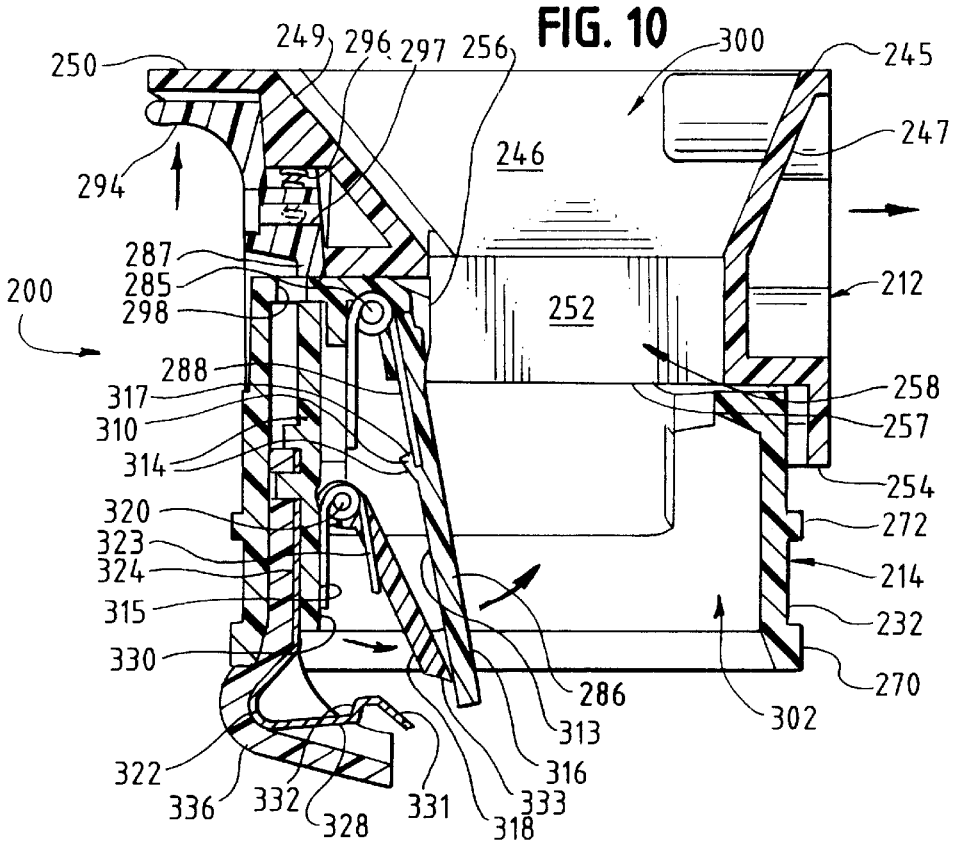
FIG. 10 is a vertical sectional view taken through the two assembled units of the invention shown prior to disassembly thereof.
Figure 11:
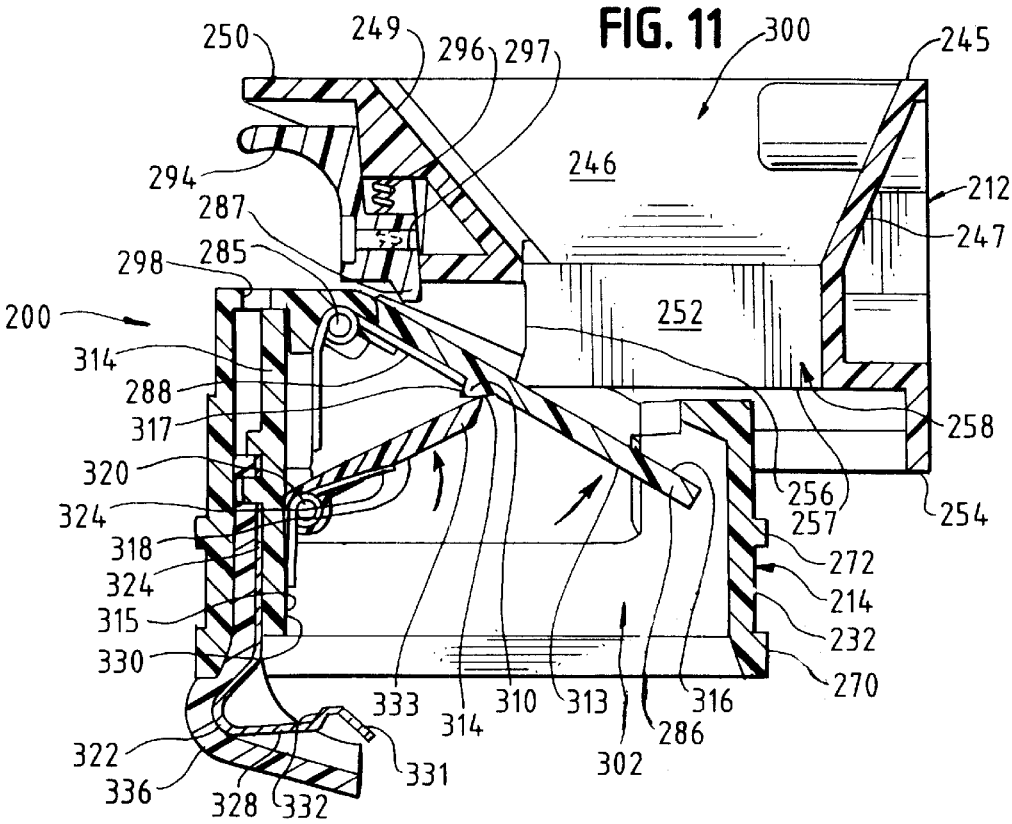
FIG. 11 is a vertical sectional view taken through the two units of the invention shown partially disassembled one from the other.
Figure 12:
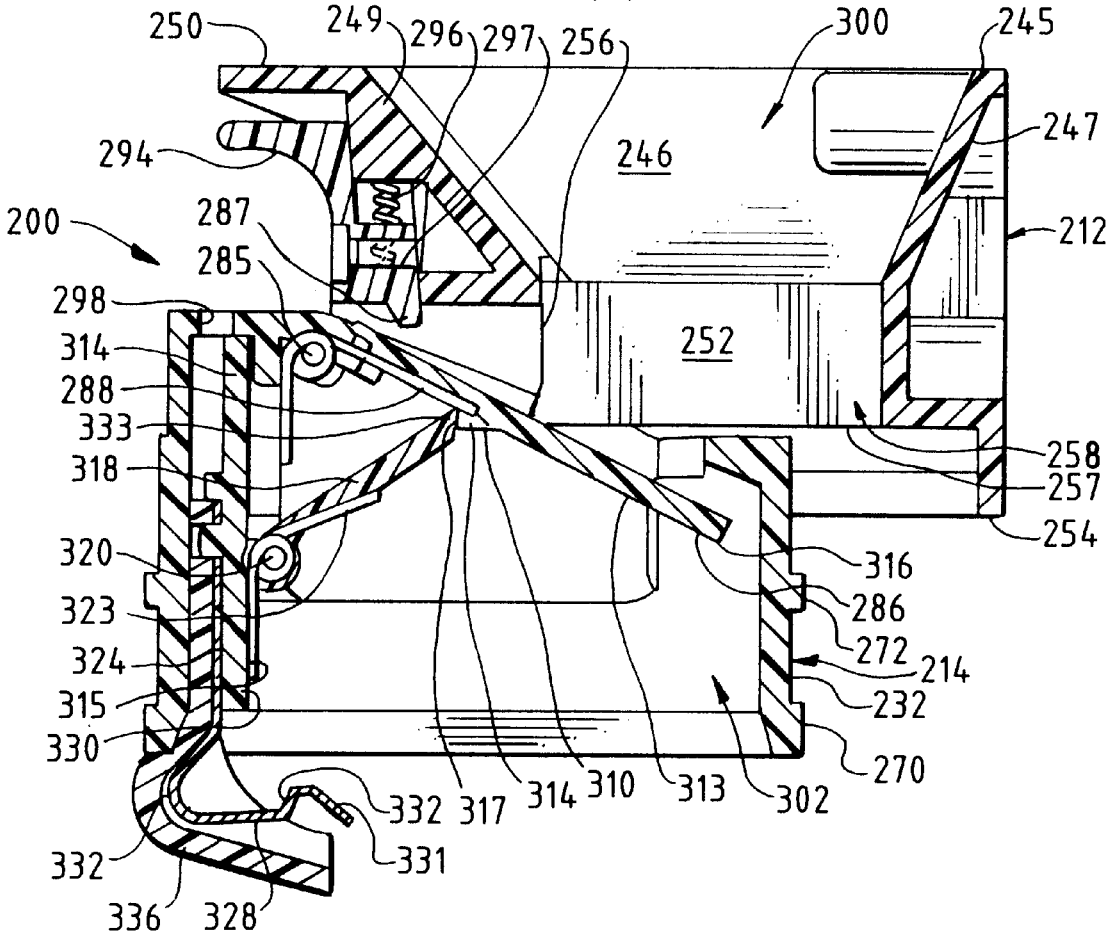
FIG. 12 is a vertical sectional view taken though the two units of the invention shown nearly fully disassembled one from the other.

The coin receptacle assembly of the invention, as illustrated in FIGS. 3 through 13 hereof, provides an improvement of the assembly disclosed in the prior art '483 Patent. Referring to FIG. 3, assembly 200 includes a funnel unit 212 and a coin receptacle unit 214 to which is attached a flexible bag 216 into which coins inserted into the vending machine (not shown) are deposited and collected when they pass through the funnel unit 212. Funnel unit 212 is substantially identical to prior art funnel unit 12, except that the unit 212 does not include the spring biased locking pin 94 or abutment formation 95 and associated locking parts of unit 12 with unit 14. Rather, as seen in FIGS. 4–13, unit 212 includes spring biased locking latch 294 having projecting wings 295 which slide in channels 293 formed in unit 212, and an abutment surface 297 with springs 296 interposed between the surface 297 and the unit 212 to normally urge the latch into its extended position shown in FIG. 5. Latch mounting screw 291 is provided to prevent latch 294 from being completely removed from channels 293 except upon removal of the screw 291. Coin receptacle unit 214 includes a cavity formation 298 into which an extension 287 formed on latch 294 is engageable when the two units 212, 214 are assembled to removably lock same together, as shown in FIG. 9. Removal of unit 214 from unit 212 is accomplished by sliding latch member 294 against the force of springs 296 to withdraw extension 287 from cavity 298 and thereby permit unit 214 to be slid out from engagement in unit 212, as shown in FIGS. 10–12.

As stated above, funnel unit 212 is in all other respects substantially identical to prior art funnel unit 12. Thus, funnel unit 212 includes a pair of opposite side walls 244 of equal length and width. The outer surface of each wall 244 is continuous and uninterrupted. Commencing from the upper edge 245 of each wall 244, the inner wall surface 244 is tapered inwardly along a portion of its width and along its entire length to provide an inwardly inclined ramp 246. A similarly dimensioned ramp 247 is formed extending inwardly from the upper edge 248 at right angles to the upper edges 245. Additionally, a similarly dimensioned ramp 249 is formed extending inwardly from the upper edge 250 also at right angles to the walls 244. The ramps 246, 247 and 249 form a four-wall funnel formation which is open at the upper edges 245, 248 and 250.

Each of the ramp walls 246 has an integral wall extension 252 extending downwardly therefrom parallel to the side walls 244 and terminating at a location spaced above the bottom edges 254 of the side walls 244. The ramp wall 249 also has a similarly dimensioned wall extension 256 integral with the wall extensions 252 to form a downwardly opening three-walled extension of the ramp walls 246, 247 and 249, with the exception that the ramp wall 247 is not provided with such a wall extension. This leaves an open space opposite the extension 256. The bottom edges of the wall extensions 252 and 256 define the discharge opening 258 of the funnel unit 212.

The wall extensions 252 and 256 have their bottom edges 257 spaced above the bottom edges 254 of the unit 212. Extending inwardly from each side wall 244, is a flange 253, the flanges facing one another to provide a ledge 259 on their top surfaces extending inwardly between the walls 244 the entire length of each such wall 244. The ledge 259 thus formed is spaced from the bottom edges 257 of the wall extensions 252 to provide a track extending between the ledge 259 and bottom edges 257. Said extensions 252 function as cams to open the normally closed closure means 280 of the unit 214 when the two units are engaged in the said track to form the assembly 200. The ledge 259 terminates flush with the lateral edges 261 defining the open side of the funnel unit 212, opposite the side 262 of said unit 212.

The side 262 of the funnel unit 212 may be provided with sockets (not shown) formed thereon for engaging fasteners therein for securing the funnel unit 212 in a vending machine's housing in a fixed position for receiving coins inserted to activate the vending machine.

The coin receptacle unit 214 of the invention is formed as a unitary molded fixture member 270 to which the bag 216 is attached to depend therefrom. Bag 216 is attached to coin receptacle unit 214 in the same manner that bag 16 is attached to unit 14 of the '483 Patent. Bag 216 is substantially similar to prior art bag 16, except that bag 216 includes a zipper closure 243 which, unlike zipper 43 of the '483 Patent, is lockable by a conventional latch and lock 241 to prevent opening of the zipper and access to the interior of the bag 216 other than by an authorized person. The fixture member 270 includes an annular wall 272 from which depends the cylindrical throat 232 on which the bag 216 is secured by means of the clamp 234. Upstanding on the wall 272 is the rectilinear shaped wall 274 on which is supported the platform 276 of rectangular configuration. Supported on the platform 276 is a housing 278 in which is pivotally mounted the closure member 280.

Figure 13:
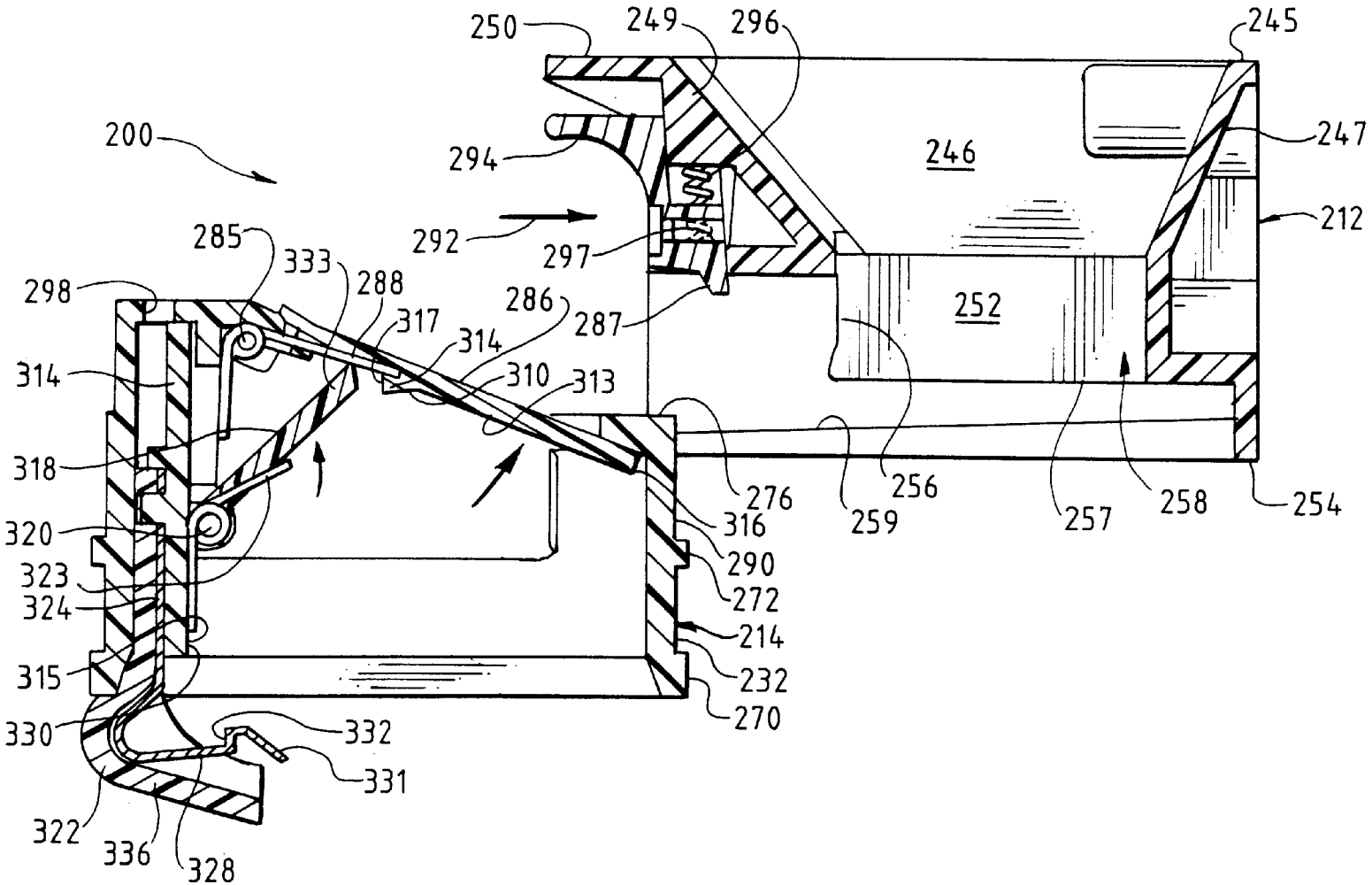
FIG. 13 is a vertical sectional view taken through the two units of the invention shown after disassembly of one from the other.

The housing 278 includes a channel-shaped vertical wall in which the parallel side walls 282 are connected by the wall 284. The side walls 282 are triangular in side elevation (see FIG. 4) and tapering away from the connecting wall 284. The closure member 280 of the invention is comprised of a secure door 286 which is pivotally mounted on the secure door shaft 285 between the side walls 282 adjacent the connecting wall 284. Secure door shaft 285 includes grooves 293 to receive retaining rings 295 to hold the shaft 285 in place between side walls 282 and to prevent the shaft from being removed from the unit 214 except as authorized from the interior of the bag 216. The secure door 286 is maintained normally in a position closing the space between the side walls 282 by means of the door torsion spring 288 mounted on the secure door shaft 287. The normally closed position of the secure door 286 is illustrated in FIG. 13 and in open position in FIG. 7 where the door is urged against the wall extensions 252. The door torsion spring 288 is a conventional coiled member from which extend a pair of arms to bias the secure door 286 to a normally closed position.

Figure 6:
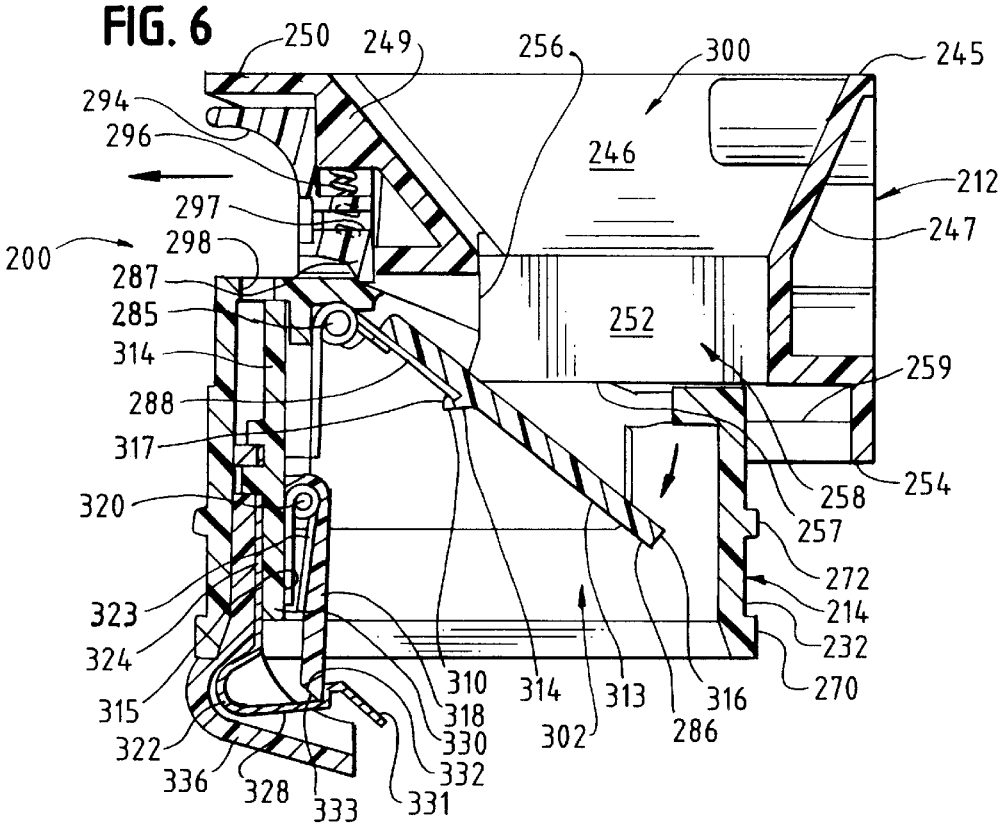
FIG. 6 is a vertical sectional view taken through the two units of the invention shown partially assembled together.

The member 270 has a central bore therethrough which connects with the interior of the bag 216. The receptacle unit 214 is assembled to the funnel unit 212 by inserting the forward end 290 of the platform 276 into the upper surfaces of the ledge 259 as represented by the arrow 292 in FIG. 13. The unit 214 is then slided to the right whereby the cam member 252 will engage the upper surface of the secure door 286 to depress the door 286 downwardly to be moved toward its open position as seen in FIG. 6. In this engagement, the door 286 will pivot on the shaft 285 against the normal bias thereagainst of the spring 288. The continued sliding movement of the unit 214 on the ledge 259 relative to the funnel unit 212 will further pivot the door 286 to a full open position depicted in FIG. 9.

The secure door 286 is maintained in its open position (see FIG. 9) when the coin receptacle unit 214 is locked on the funnel unit 212 by engagement of extension 297 of the spring biased locking latch 294 within cavity formation 298 of coin receptacle unit 214. When the assembly 200 of the invention is fully engaged, the door 286 is fully open so that coins.dropping into the funnel formation 300 will pass through the passageway 302 into the bag 216.

Coin receptacle unit 214 includes the improved elements over the structure of the '483 Patent which enable the secure door 286 to be automatically locked when the unit 214 is removed from its engagement with funnel unit 212. Secure door 286 is provided on its underside 313 facing passageway 302 with a generally triangular-shaped locking ramp 310 having an angled surface 314 facing free end 316 of door 286 and an abutment surface 317 facing the opposite end of door 286 which carries secure door shaft 285. Lock arm assembly 312 is provided within unit 214 opposite connecting wall 284. Assembly 312 includes lock mount member 314 with a bushing 316 upon which is adapted to be pivotally positioned lock arm 318. Lock arm 318 is held upon lock mount member 314 by engagement of lock arm shaft 320 between passageways 321 of the lock arm which align with bushing 316 of member 314. A pair of lock arm torsion springs 323, 325 is positioned upon shaft 320 and engaged between lock arm 318 and member 314 to always force the lock arm pivotally away from member 314 and toward secure door 286.

Lock arm spring 322, which is of generally L-shaped configuration, is secured to lock mount member 314 with the longer leg 324 of spring 322 mounted against the side 326 of member 314 opposite the side 315 thereof against which lock arm 318 is pivotally secured. The shorter leg 328 of spring 322 extends below the lower end 330 of member 314 and terminates at angled surface 331 having lock groove 332 into which the free end 333 of lock arm 318 is adapted to be releasably engaged when the arm is pivoted toward side 315 of member 314. Lock arm spring protector 336 is mounted to lock mount member 314 with spring 322 positioned between protector 336 and member 314 so as to protect the spring from damage thereto.

Figure 5:
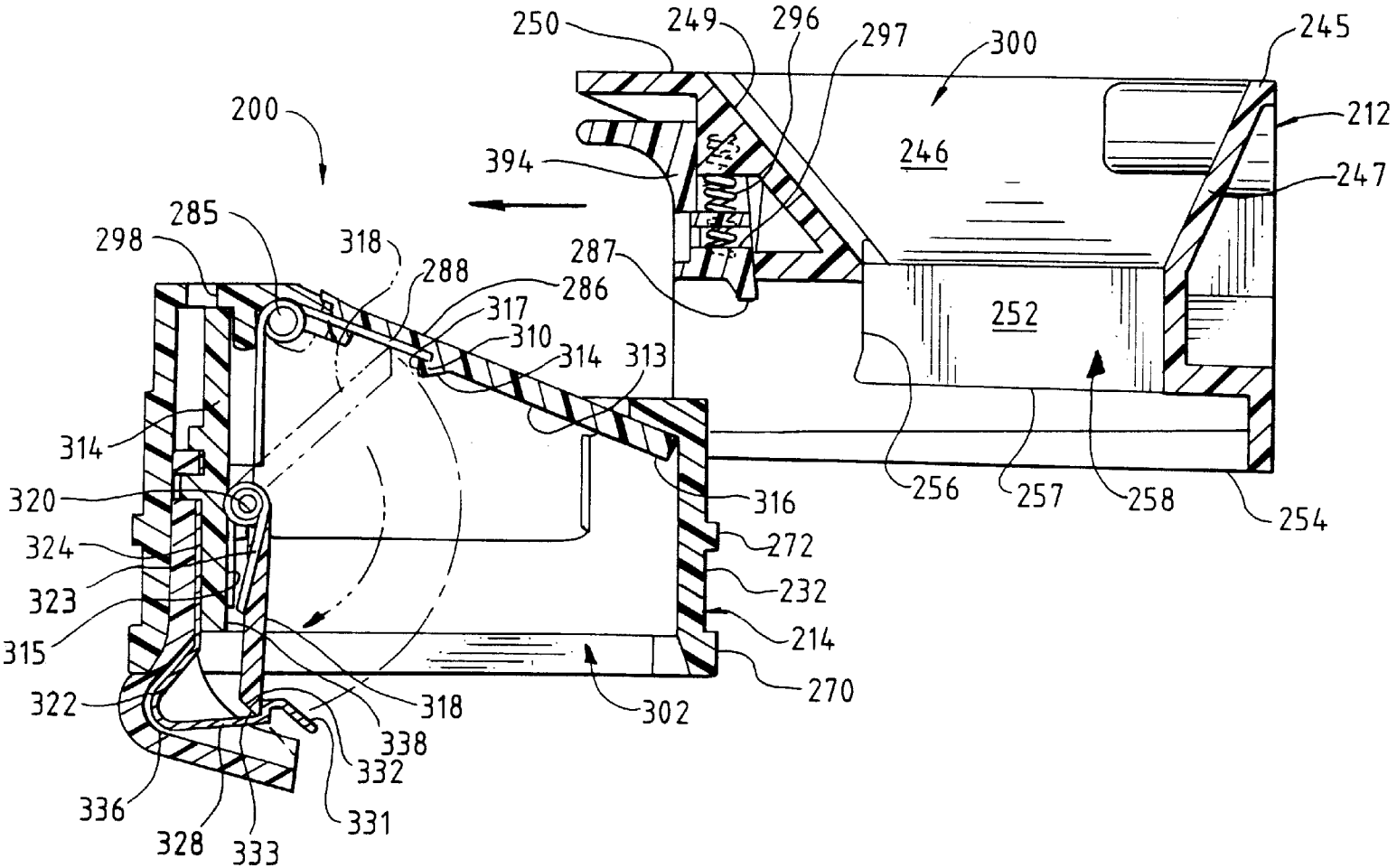
FIG. 5 is a vertical sectional view taken through the two units of the invention shown prior to assembly together.

The lock arm assembly 312 functions together with secure door 286 to automatically lock the secure door when unit 214 is removed from unit 212 in the following manner. Prior to assembly of units 212 and 214 together, as seen in FIGS. 5 and 13, secure door 286 is urged to its closed position by torsion spring 288. An authorized person unlocks latch and lock 241 of bag 216, unzips zipper closure 243 and reaches into the inside of the bag and grasps the lock arm 318 to "set" the lock arm by pivoting same about shaft 320 against the force of springs 324, 326 and snap the free end 333 of the lock arm over angled surface 331 of spring 322 into lock groove 332, as seen in solid lines in FIG. 5. Lock arm 318 thereby is retained to permit secure door 286 to move freely between its open and closed positions. The authorized person then re-locks the latch and lock 241 of bag 216. Coin receptacle unit 214 is then ready to be assembled upon funnel unit 212 positioned in a vending machine.

Figure 7:
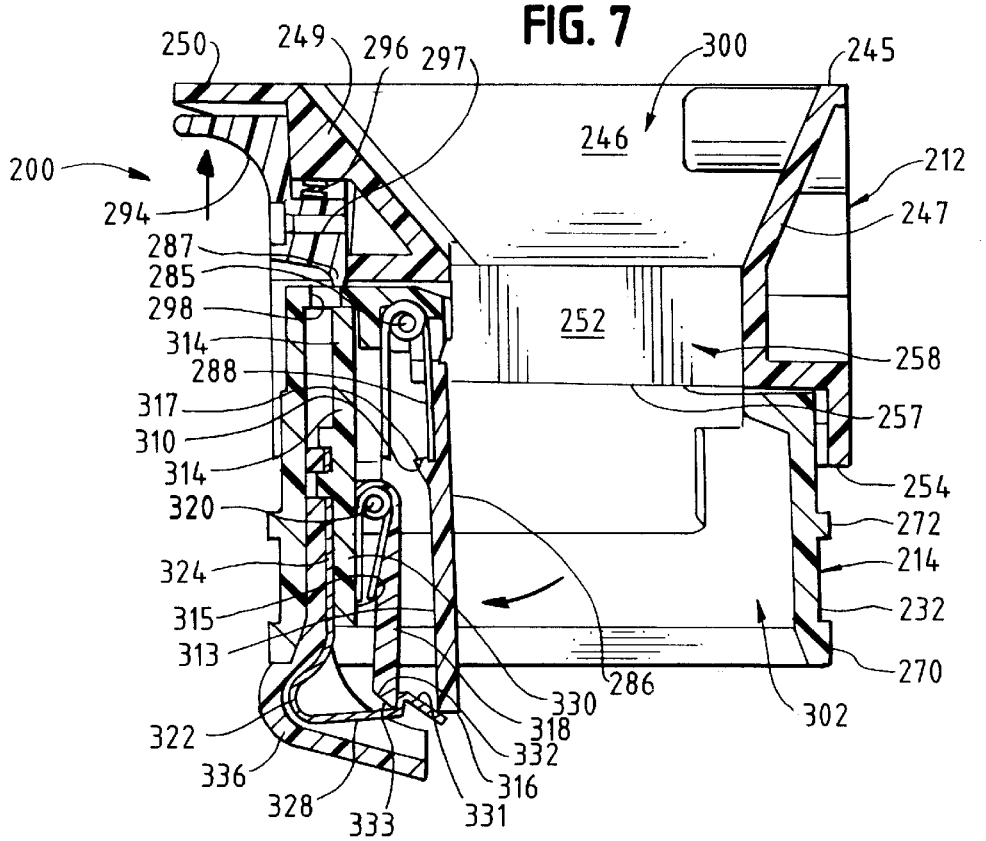
FIG. 7 is a vertical sectional view taken through the two units of the invention shown assembled together.
Figure 8:
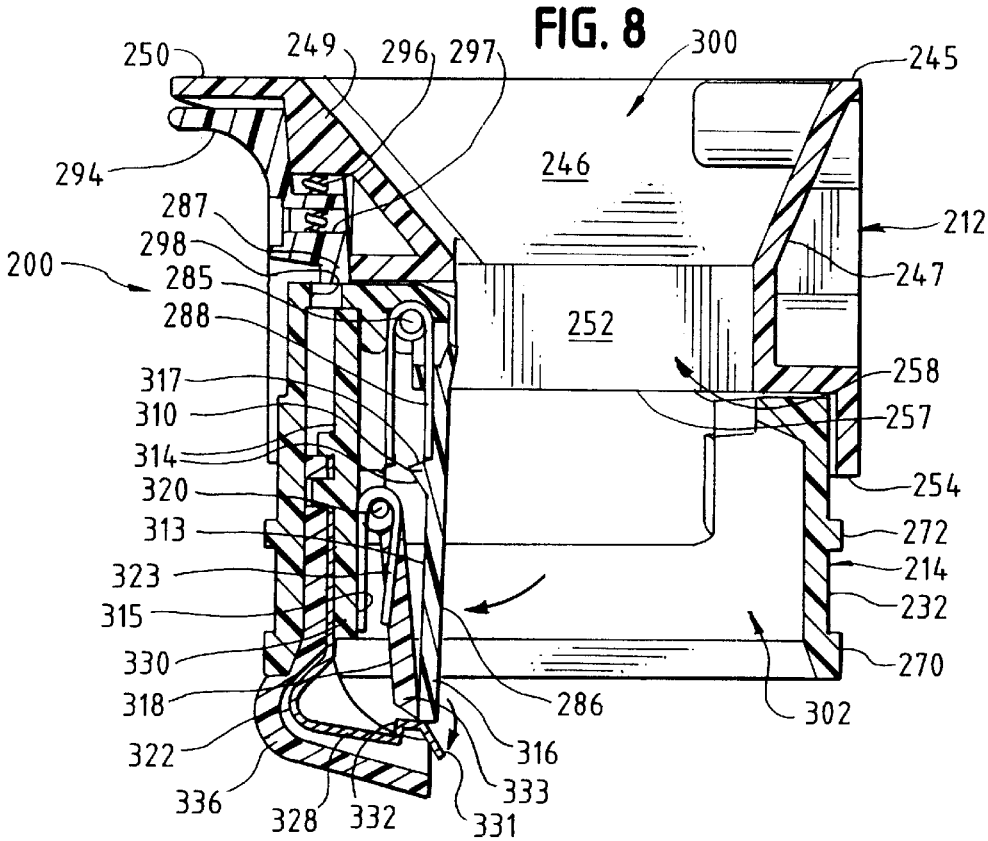
FIG. 8 is a vertical sectional view taken through the two assembled units of the invention shown with the secure door releasing the lock arm from the lock arm spring.

Upon assembly of unit 214 upon unit 212, secure door 286 first is urged toward its open position by cam member 252, as seen in FIG. 6, and then into engagement with angled surface 331 of spring 332, as seen in FIG. 7. Just prior to full assembly of units 212 and 214, secure door 286 passes over angled surface 331 (see FIG. 8), and upon full assembly of units 212, 214 together, the free end 316 of door 286 is forced against lock arm 318 and pushes same back so that free end 316 rests in lock groove 332 (see FIG. 9). In this position, extension 287 of unit 212 latch 294 is engaged in cavity formation 298 of unit 214 to lock the same together.

When a service person removes unit 214 from unit 212, the person first moves latch 294 to disengage extension 287 from cavity 298, as seen in FIG. 10, and pulls unit 214 out of engagement from unit 212. Such action causes free end 316 of secure door 286 to disengage from lock groove 332 and also to permit free end 333 of lock arm 318 to move out of the lock groove and pivot against secure door 286 towards its open position, as seen in FIG. 10. Continued movement of unit 214 out of engagement with unit 212 permits secure door 286 and lock arm 318 to pivot toward the completely closed position of the secure door (see FIGS. 11 and 12). During such pivotal movement, the free end 333 of lock arm 318 rides against the underside 313 of secure door 286, passes over inclined surface 314 of locking arm 310 and past abutment surface 317 to the position shown in FIG. 13 in which units 212 and 214 are completely disengaged. When lock arm 318 is in the position shown in FIG. 13, any attempt by an unauthorized person to open secure door 286 by pushing against the top surface thereof will be prevented because such attempted movement of the secure door will result in the free end 333 of lock arm 318 engaging against abutment surface 317 of the secure door to prevent further pivoting of the door toward its open position. Thus, the secure door is automatically locked when the two units 212 and 214 are separated one from the other. A tamper flange 350 is formed on the external surface of secure door 286 to prevent an object from being inserted past the door to push the lock arm past the abutment surface 317 by an unauthorized person.

The procedure to "re-set" the lock arm to its position shown in FIG. 5 is repeated, as described above, by an authorized person after the unit 214 with coin-filled bag 216 is retrieved, the latch and lock 241 is unlocked, and the bag is emptied.

Other configurations and variations in the structure, arrangement and size of the various parts may occur to those skilled in the art without department from the spirit or circumventing the scope of the invention as set forth in the appended claims.

What is claimed is:

1. A coin receptacle assembly for a coin operated machine comprising:

a) a funnel unit having an upper open end and a lower open discharge end adapted to be anchored on the interior of the machine in position to receive the coins through said upper open end which were inserted into the machine to activate the machine;

b) a receptacle unit adapted to be removably assembled with the funnel unit in position to receive the coins passing into the funnel unit and discharged through the lower open end of the funnel unit;

c) said receptacle unit including a storage container suspended therefrom in position to receive the coins discharged through said lower open discharge end of the funnel unit, the container having an interior compartment opening to said receptacle unit and into which the coins are received, and a lockable closure to prevent unauthorized access to said interior compartment;

d) said funnel unit having an internal ledge opening to a lateral face of the funnel unit and said receptacle unit having a complementary wall adapted to be inserted into the funnel unit through said opening in a linear movement and engaged along said ledge for assembly of the receptacle unit with the funnel unit;

e) said receptacle unit including a pivotal secure door installed in an upper end thereof including means operative to normally bias said secure door to a position closing-off said upper end, said funnel unit having cam means arranged to pivot said secure door to an open position when the receptacle unit is assembled with the funnel unit;

f) a lock arm assembly pivotally mounted within said receptacle unit, said lock arm assembly being cooperatively engageable with said secure door to automatically lock said secure door in said position closing-off said upper end of the receptacle unit when the receptacle unit is removed from said funnel unit; and wherein the secure door has a top side and an underside facing the interior compartment of the storage container, said underside including an abutment surface, said lock arm assembly being engageable against said abutment surface when the receptacle unit is removed from the funnel unit.

2. The coin receptacle assembly as claimed in claim 1 in which said underside includes a generally triangular-shaped locking ramp having an angled surface.

3. The coin receptacle assembly as claimed in claim 2 in which the lock arm assembly includes a lock arm having a free end, the free end being engaged against the abutment surface when the receptacle unit is removed from the funnel unit.

4. The coin receptacle assembly as claimed in claim 3 including a lock arm spring associated with said lock arm, said lock arm spring having a lock groove into which said free end is adapted to be releasably engaged when the receptacle unit is assembled with the funnel unit.

5. The coin receptacle assembly as claimed in claim 4 in which the secure door is engaged against the lock arm spring when the receptacle unit is assembled with the funnel unit.

6. The coin receptacle assembly as claimed in claim 5 in which each of the secure door and the lock arm is disengaged from the lock arm spring when the receptacle unit is removed from the funnel unit.

7. An assembly for collecting coins inserted into a vending machine comprising:

a) a funnel unit open at opposite upper and lower ends thereof for passing coins therethrough inserted into the machine, said unit including bracket means for anchoring the unit on the interior of the machine in position for accepting coins inserted into the machine;

b) a receptacle unit adapted to be slidably engaged with said funnel unit to complete the assembly for receiving coins passing through the funnel unit;

c) said receptacle unit having a bag suspended therefrom in position to collect the coins passing through the units, the bag having an interior compartment opening to said receptacle unit and a lockable closure to prevent unauthorized access to said interior compartment;

d) said units having cooperating locking means for releasably locking the units together when the assembly is completed;

e) said funnel unit having a pair of inwardly facing ledges open to a lateral face of the funnel unit to provide a track, said receptacle unit having a protruding wall arranged to be inserted along said track for assembly of said receptacle unit with said funnel unit;

f) said receptacle unit including a pivotal secure door spring-biased to a position normally preventing entry thereinto of coins, said funnel unit having cam means arranged to engage and pivot the secure door to an open position permitting coins to pass into the bag when the two units are completely assembled;

g) a lock arm assembly pivotally mounted within said receptacle unit, said lock arm assembly being cooperatively engaged with said secure door to automatically lock said secure door in said position preventing entry into said receptacle unit when the two units are disassembled; and wherein the secure door has a top side and an underside facing the interior compartment of the bag, said underside including an abutment surface, said lock arm assembly being engageable against said abutment surface when the receptacle unit is removed from the funnel unit.

8. The assembly for collecting coins as claimed in claim 7 in which said underside includes a generally triangular-shaped locking ramp having an angled surface.

9. The assembly for collecting coins as claimed in claim 8 in which the lock assembly includes a lock arm having a free end, the free end being engaged against the abutment surface when the receptacle unit is removed from the funnel unit.

10. The assembly for collecting coins as claimed in claim 9 including a lock arm spring associated with said lock arm, said lock arm spring having a lock groove into which said free end is adapted to be releasably engaged when the receptacle unit is assembled with the funnel unit.

11. The assembly for collecting coins as claimed in claim 10 in which the secure door is engaged against the lock arm spring when the receptacle unit is assembled with the funnel unit.

12. The assembly for collecting coins as claimed in claim 11 in which each of the secure door and the lock arm is disengaged from the lock arm spring when the receptacle unit is removed from the funnel unit.

* * * * *